US010767417B2

(12) United States Patent
Andrade

(10) Patent No.: US 10,767,417 B2
(45) Date of Patent: Sep. 8, 2020

(54) ACCESSORY TRAY FOR ATTACHMENT TO A FOLDING STEP LADDER

(71) Applicant: Enrique Andrade, Hialeah, FL (US)

(72) Inventor: Enrique Andrade, Hialeah, FL (US)

( * ) Notice: Subject to any disclaimer, the term of this patent is extended or adjusted under 35 U.S.C. 154(b) by 0 days.

(21) Appl. No.: 15/659,148

(22) Filed: Jul. 25, 2017

(65) Prior Publication Data

US 2018/0023345 A1 Jan. 25, 2018

Related U.S. Application Data

(60) Provisional application No. 62/366,401, filed on Jul. 25, 2016.

(51) Int. Cl.

| | |
|---|---|
| ***E06C 7/14*** | (2006.01) |
| ***A47B 5/04*** | (2006.01) |
| ***A47B 13/08*** | (2006.01) |

(52) U.S. Cl.

CPC ..... *E06C 7/14* (2013.01); *A47B 5/04* (2013.01); *A47B 13/083* (2013.01)

(58) Field of Classification Search

CPC ..... E06C 7/14; A47B 5/05; A47B 13/083
See application file for complete search history.

(56) References Cited

U.S. PATENT DOCUMENTS 1,580,289 A * 4/1926 Cummings ..... A47B 5/04 108/134
3,052,442 A * 9/1962 Rankin, Jr. ..... E06C 7/14 248/210
4,100,858 A * 7/1978 Bue ..... A47B 5/04 108/48
4,445,659 A * 5/1984 Lachance ..... E06C 7/143 182/120
5,031,723 A * 7/1991 Hooten ..... E06C 1/38 182/120
5,158,023 A * 10/1992 Allen ..... E04G 5/00 108/42
5,191,954 A * 3/1993 Ledford ..... E06C 7/143 182/121
5,419,409 A * 5/1995 Corulla ..... E06C 7/14 182/129
5,722,507 A * 3/1998 Kain ..... E06C 1/393 182/104

(Continued)

FOREIGN PATENT DOCUMENTS

DE 202016004085 U1 * 8/2016 ..... A47B 5/04

*Primary Examiner* — Katherine W Mitchell
*Assistant Examiner* — Candace L Bradford
(74) *Attorney, Agent, or Firm* — Sanchelima & Associates, P.A.; Christian Sanchelima; Jesus Sanchelima

(57) ABSTRACT

An accessory device for attachment to a folding step ladder includes a square or rectangular receiver frame that hingedly attaches to the top end of the ladder and a tray that is removably supported within the receiver frame. In a preferred embodiment, the receiver frame is attached with two or more hinges to the ladder and includes collapsible pivoting support arms on opposite sides extending between and connecting to the sides of the receiver frame and the ladder. In use, the receiver frame is supported horizontally, extending out from the top of the ladder, and is held by the support arms that lock into an extended position. When not in use, the receiver frame is folded down and collapsed against the side of the ladder for transport and storage.

7 Claims, 3 Drawing Sheets

(56) References Cited

U.S. PATENT DOCUMENTS 5,913,380 A * 6/1999 Gugel ..... B25H 3/023 182/129
6,041,723 A * 3/2000 Peterson ..... A47B 3/00 108/115
6,161,486 A * 12/2000 Boots ..... A47B 5/06 108/33
6,352,135 B1 * 3/2002 Jones ..... E06C 7/143 182/120
6,443,260 B1 * 9/2002 Katz ..... B25H 3/06 182/129
6,467,577 B1 * 10/2002 Charlebois, Jr. ..... E06C 7/14 182/121
7,044,178 B1 * 5/2006 Campbell ..... B25H 1/12 144/285
7,063,187 B1 * 6/2006 Lavigne ..... E06C 1/39 182/129
9,045,940 B2 * 6/2015 Walters ..... E06O 7/143
9,381,605 B2 * 7/2016 Moyer ..... A47B 3/0803
D771,384 S * 11/2016 Aldredge ..... D3/313
2006/0192063 A1 * 8/2006 Angotti ..... E06C 7/14 248/210
2007/0034124 A1 * 2/2007 Benson ..... B60N 3/002 108/134
2007/0181761 A1 * 8/2007 Astor ..... E06C 7/14 248/238
2009/0078504 A1 * 3/2009 Astor ..... E06C 7/14 182/129
2009/0229918 A1 * 9/2009 Moss ..... E06C 1/18 182/129
2009/0308287 A1 * 12/2009 Chen ..... A47B 5/04 108/42
2018/0023345 A1 * 1/2018 Andrade ..... A47B 5/04 108/25

* cited by examiner

ACCESSORY TRAY FOR ATTACHMENT TO A FOLDING STEP LADDER

BACKGROUND OF THE INVENTION

This non-provisional patent application is based on provisional patent application Ser. No. 62/366,401 filed Jul. 25, 2016.

FIELD OF THE INVENTION

This invention relates to accessory devices for ladders, and more particularly, to a device for holding a tray, bag or other container at the top of a folding step ladder for holding tools, hardware and other items when using the ladder.

DISCUSSION OF THE RELATED ART

Folding step ladders are used for all types of jobs and in many different trades, including, but not limited to, electrical, plumbing, painting, carpentry and landscaping. When using a ladder, it is often necessary to carry various tools, hardware, parts and/or other objects up the ladder for performing the particular task at hand. However, it can be difficult to segregate the various items needed when standing on a ladder, and, in most cases, these items are placed either loosely on the top of the ladder or held by the person standing on the ladder as they attempt to perform a particular job. Sometimes, tools, hardware and other items are dropped or roll off the top of the ladder and fall to the ground. Dropping items causes not only inconvenience, but can present a safety issue for the person standing on the ladder when trying to catch items that are dropped or fall from the ladder. Moreover, tools and other heavy or sharp objects that are dropped from the ladder can cause damage to floor surfaces (e.g., wood, marble and ceramic tile floors). The person must then climb down the ladder and retrieve any dropped items before climbing back up the ladder to continue the job.

Accordingly, there remains a need for a device that can be easily attached to existing step ladders for supporting a tray, bag or other container at the top of the ladder for holding various tools, hardware and other items needed when using the ladder.

SUMMARY OF THE INVENTION

The present invention is directed to an accessory device for attachment to a folding step ladder. The accessory device includes a square or rectangular receiver frame that hingedly attaches to the top end of the ladder and a tray that is removably supported within the receiver frame. In a preferred embodiment, the receiver frame is attached to the ladder with two or more hinges and includes collapsible pivoting support arms on opposite sides that extend at an angle between the sides of the receiver frame and the ladder. The ends of the support arms connect to the receiver frame and to the ladder below the top end of the ladder. The tray may include one or more compartments to accommodate tools, parts, hardware, supplies and other items and may be specifically designed and compartmentalized to accommodate specific uses and/or trades (e.g., painters, electricians, plumbers, landscapers, homeowners, etc.). In use, the receiver frame is supported horizontally, extending out from the top of the ladder, and is held by the support arms that lock into an extended position. The tray is then received within the receiver frame and held in the horizontal position at the top of the ladder. When not in use, the receiver frame is folded down and collapsed against the side of the ladder for transport and storage. The tray can be removed or remain in the receiver frame when collapsed against the ladder.

OBJECTS AND ADVANTAGES OF THE INVENTION

Considering the forgoing, it is a primary object of the present invention to provide an accessory device for a ladder which promotes greater speed and efficiency when using the ladder.

It is still a further object of the present invention to provide an accessory device for a ladder, as shown and described herein, which reduces the amount of time it takes to go up and down the ladder to get supplies.

It is still a further object of the present invention to provide an accessory device for a ladder that gives the user of the ladder the option of when it is needed to be used, and which is adapted to be folded to a collapsed state against the ladder when not in use.

It is still a further object of the present invention to provide an accessory device for a ladder that is adapted for various purposes, and which allows the user to support any of a variety of trays, containers or bags for holding items while using the ladder.

It is still a further object of the present invention to provide an accessory device for a ladder, as shown and described herein, and which is universal and practical for use with any conventional folding step ladder.

It is yet a further object of the present invention to provide an accessory device for a ladder which eliminates property damage to due lack of space for tools, once climbed on the ladder, and wherein the device prevents tools, hardware and other objects from falling off the ladder and onto wood, marble or ceramic floors which may cause damage.

It is yet a further object of the present invention to provide an accessory device for a folding ladder that is easy to assemble and install on any conventional folding ladder.

It is still a further object of the present invention to provide an accessory device for a folding ladder that makes convenient use of otherwise dead space between the ladder and a vertical wall surface when using the ladder.

It is still a further object of the present invention to provide an accessory device that is adapted to hold various trays on the top of a ladder in a horizontal, supported position, and wherein the trays are removable and specifically designed for various purposes and tasks.

It is still a further object of the present invention to provide an accessory device for a folding ladder which accommodates various trays that are compartmentalized for holding hardware, parts, tools and other items.

It is yet a further object of the present invention to provide an accessory device for attachment to an existing folding step ladder and wherein the accessory device is specifically adapted for supporting a bag or other container to hold Christmas ornaments, decorations and the like.

These and other objects and advantages of the present invention are more readily apparent with reference to the following detailed description taken in conjunction with the accompanying drawings.

BRIEF DESCRIPTION OF THE DRAWINGS

For a fuller understanding of the nature of the present invention, reference should be made to the following detailed description taken in conjunction with the accompanying drawings in which.

Like reference numerals refer to like parts throughout the several views of the drawings.

DETAILED DESCRIPTION OF THE PREFERRED EMBODIMENT

Figure 1:
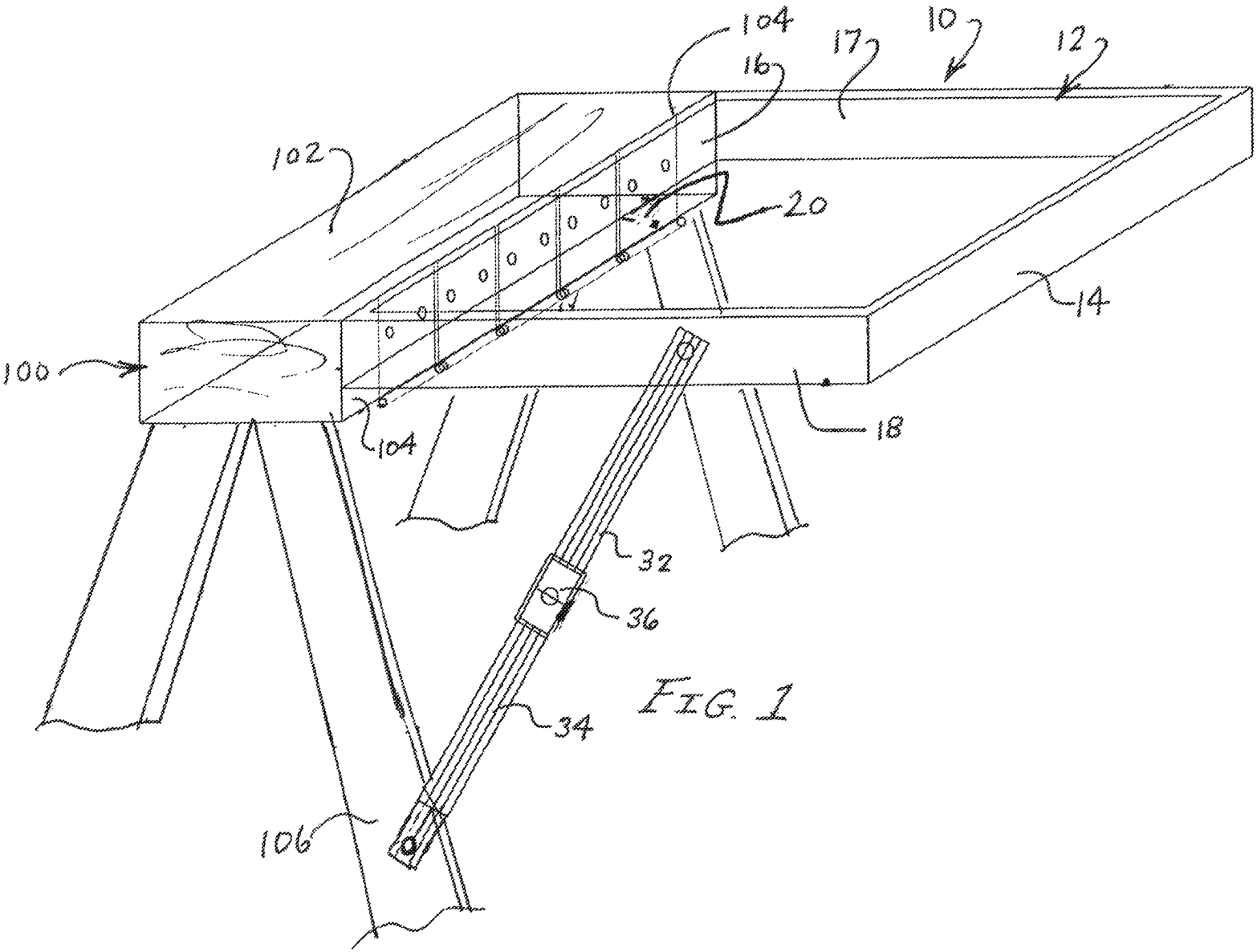
FIG. 1 is perspective view showing the accessory device of the present invention installed on the top of a step ladder and supported in the extended, operable position to receive a tray, bag or other container.
Figure 2:
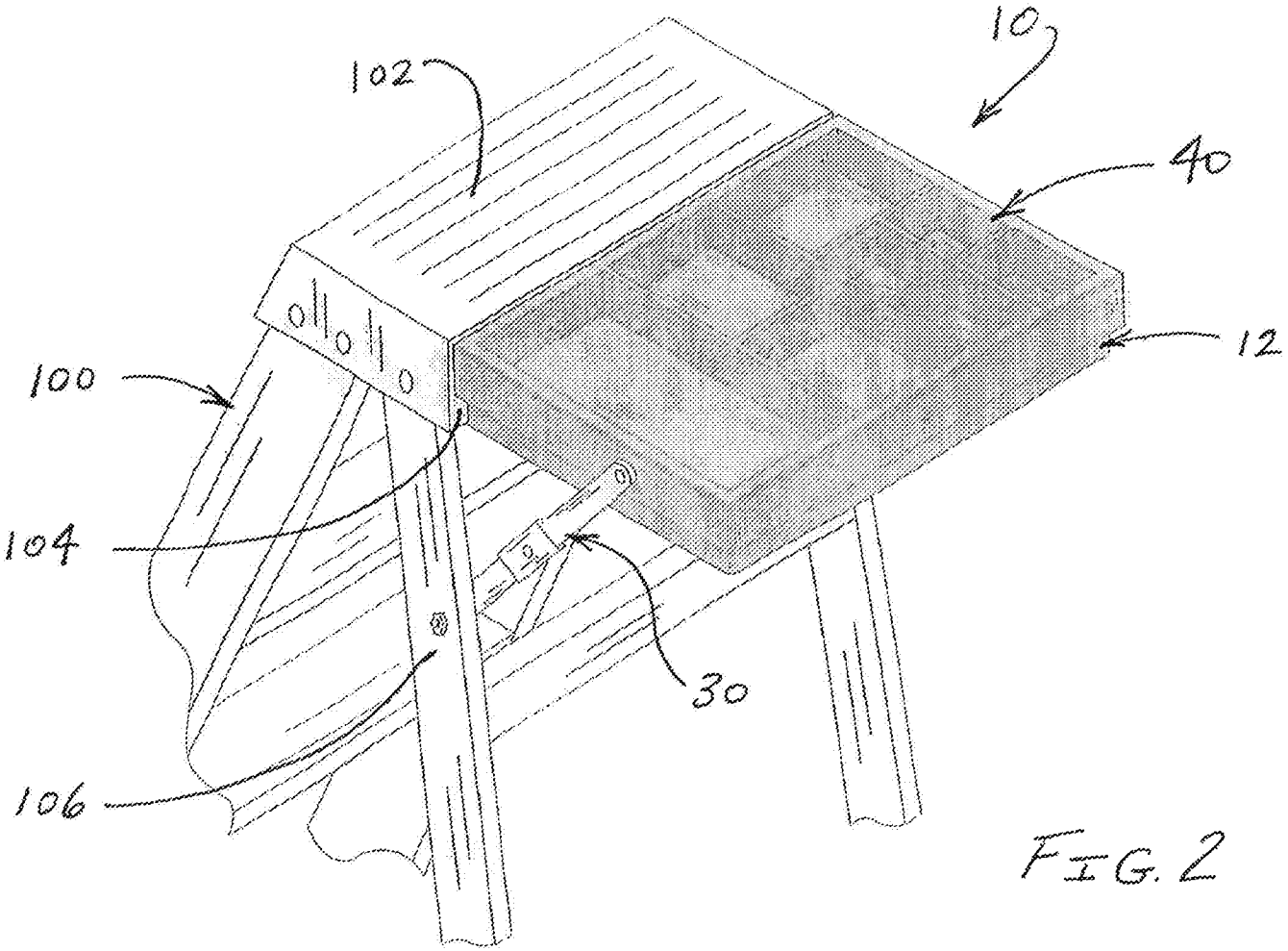
FIG. 2 is a top perspective view showing the accessory device of the present invention installed on the top of a folding step ladder, and wherein the accessory device supports a compartmentalized tray that is removably received within the receiver frame of the device.
Figure 3:
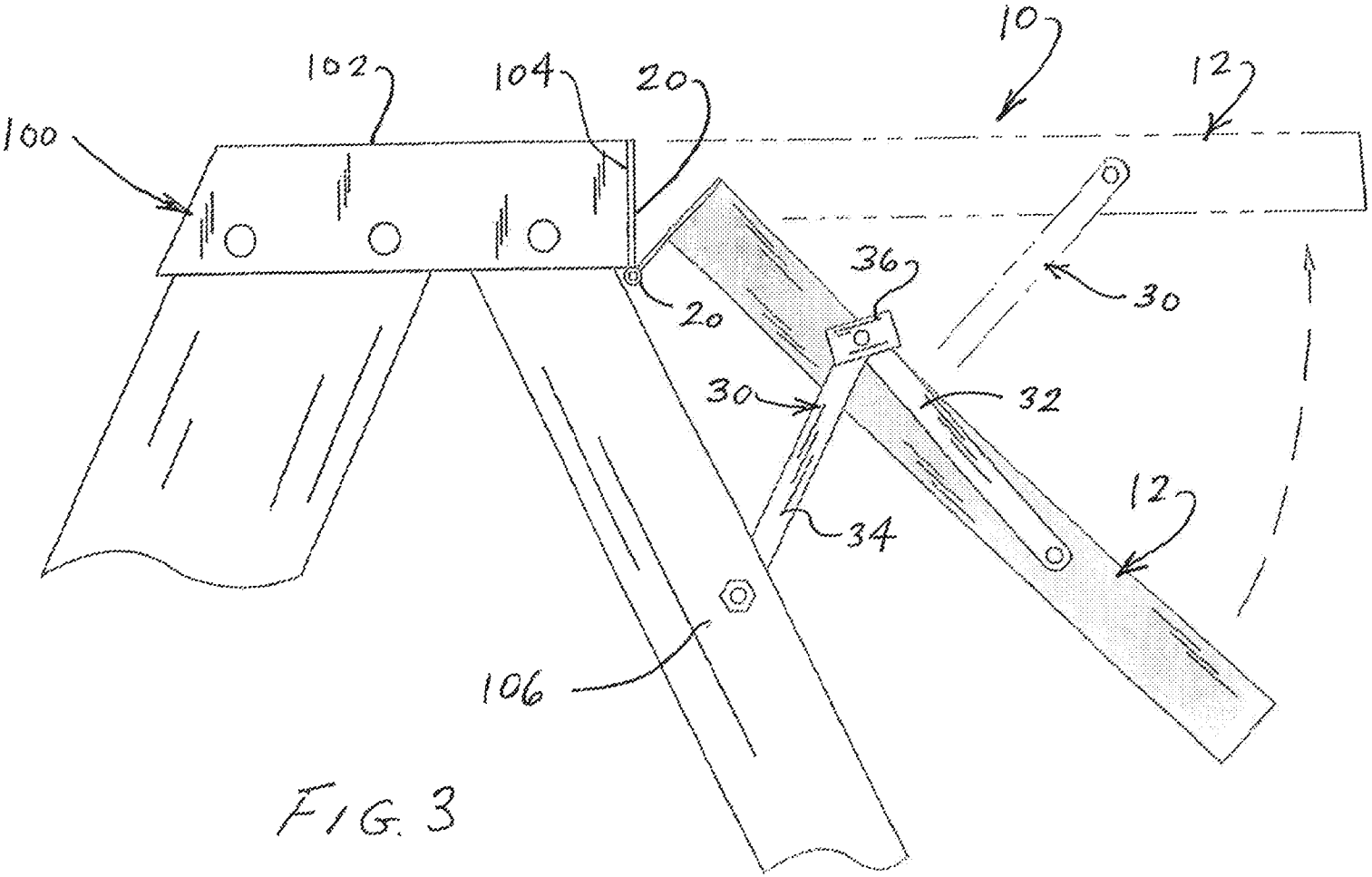
FIG. 3 is a side elevational view showing the accessory device of the present invention being moved between a folded, stowed position and an extended, operable position on the top of a folding step ladder.

The ladder accessory device of the present invention is shown throughout the several views of the drawings and is generally indicated as 10. As seen in FIGS. 1 and 4, the ladder accessory device 10 includes a receiver frame 12 that is either square or rectangular in configuration and includes a front end 14, a rear end 16 and opposite sides 17 and 18. The square or rectangular receiver frame 10 may be formed of aluminum, plastic (e.g., recyclable plastic), or other suitable rigid material that provides sufficient strength to hold the weight of tools, equipment, hardware and other items. As seen in FIG. 1, the front and rear ends 14, 16 and opposite sides 17, 18 of the receiver frame 12 are generally constructed as a unitary structure and each have a thickness of approximately 0.25 inch and a height or width of approximately 1.5 inches. In the embodiment shown throughout the several views of the drawings, the front and rear ends 14, 16 are slightly shorter than the opposite sides 17, 18. In one preferred embodiment, the front and rear ends 14,16 of the receiver frame 12 have a length of approximately 13 inches, while the opposite sides 17, 18 have a length of approximately 13.75 inches. Holes are provided in the rear end 16 of the receiver frame 12 for accommodating screws or other fastening hardware of hinges 20 that hingedly attach the receiver frame 12 to the top of a folding ladder 100, as shown in FIGS. 1-3. Specifically, one leaf or plate of the hinge 20 is secured to the front face 104 of the top 102 of the ladder 100 while the other leaf or face of the hinge 20 attaches to the rear end 16 of the receiver frame 12 via the holes formed therein. In a preferred embodiment, two hinges 20 are used to hingedly attach the receiver frame 12 to the ladder 100.

The ladder accessory device 10 of the present invention further includes collapsible pivoting support arms 30 that connect to the opposite sides 17, 18 of the receiver frame 12 and to the side of a leg 106 of the ladder 100. Specifically, one pivoting support arm 30 connects between the side 17 of the receiver frame 12 and to one side leg 106 of the ladder, while another one of the pivoting support arms 30 connects between the side 18 of the receiver frame 12 and an opposite side leg 106 of the ladder 100, as seen in FIGS. 1-3. Each pivoting support arm 30 includes a first arm member 32 and a second arm member 34 that are joined together at a pivoting locking member 36 that allows the arm members 32, 34 to pivot and collapse, as seen in FIG. 3 and to be then extended to a linear support position, wherein the pivoting locking member 36 holds the arm members 32, 34 in the extended, operable locked position, as seen in FIGS. 1 and 2 to thereby support the receiver frame 12 in an outwardly extended, horizontal position, defining an operable position.

The receiver frame 12 is particularly suited for supporting a removable tray 40 therein, as seen in FIG. 2. The tray 40 may have one large compartment or, alternatively, multiple compartments of the same or different sizes. In FIG. 2, an example of a tray 40, is shown wherein multiple compartments of various size are provided in the tray for holding different items, such as screws, nails and other hardware, as well as tools or other items. The tray includes a peripheral lip that engages with the top edges of the receiver frame 12, and possibly extending over the outer sides of the frame 12. Different trays may be configured and designed to accommodate various purposes, such as for painting, carpentry, electrical work, landscaping, plumbing and the like. The tray may also be suited to accommodate support of power tools and other equipment, such as a small circular saw or drill press, as well as handheld power tools.

The receiver frame 12 may further accommodate other size and configured containers, such as a bucket that is shaped to fit and be supported within the receiver frame 12, or a bag that can be clipped to the sides 17, 18 as well as the front end 14 and rear end 16 of the receiver frame, for placement of items such as Christmas lights or ornaments therein when decorating a tree or house.

While the present invention has been shown and described in accordance with a preferred and practical embodiment thereof, it is recognized that departures from the instant disclosure are fully contemplated within the spirit and scope of the present invention.

What is claimed is:

1. An accessory device comprising:

a step ladder having front side rails and rear non-climbing side rails connected to each other using a spreader, said step ladder also includes a top cap at a topmost distal end of said step ladder, said top cap having a front face facing said front side rails and a rear face facing said rear non-climbing side rails;

a receiver frame mounted to said top cap at a first end and mounted to said rear non-climbing side rails at a second end, said receiver frame including a plurality of linear frame members extending about an outer periphery of the device and surrounding a single rectangular unobstructed open area having a size that is defined by boundaries of the linear frame members at the outer periphery, and the plurality of linear frame members including a front frame member, a rear frame member, a left side frame member and a right side frame member, the left and right side frame members extending between the front and rear frame members, and each of the plurality of frame members including a top edge adjacent to an open top of the open rectangular area, and each of the plurality of frame members further including a bottom edge adjacent to an open bottom of the open rectangular area, thereby defining an unobstructed passage extending through the open top and the open bottom, and the receiver frame being structured and disposed for supported receipt of a container device within the unobstructed open area with the container device extending downward and below the open bottom of the receiver frame;

a hinge arrangement having a plurality of hinges each having a first leaf and a second leaf connected to each other using a pin and barrel hinge configuration, said first leaf is mounted flush against said rear face and said second leaf is mounted flush against said rear frame member, said second leaf has a height greater than the height of said rear frame member, said second leaf extends below the periphery of said rear frame member, said first leaf has a height that is equal to the height of said rear face, said pin and barrel hinge configuration is entirely below said top cap, a connection between said first leaf, said pin and barrel configuration, and said second leaf leaves no bottom gap between the rear frame member and the top cap; and a pair of collapsible pivoting support arms each having a first end attachable to a respective one of the left and right frame members of the receiver frame, and an opposite second end attachable to a leg of the step ladder, and the pair of collapsible pivoting support arms being structured and disposed for allowing movement of the receiver frame relative to the step ladder between an operable position wherein the receiver frame is held supported in a horizontal orientation extending out from the top portion of the step ladder, and a stowed position wherein the receiver frame is collapsed down towards the legs of the step ladder.

2. The accessory device as recited in claim 1 wherein the container device comprises a tray that is sized, structured and configured for supported receipt within the open area of the receiver frame.

3. The accessory device as recited in claim 2 wherein the tray includes a plurality of segregated compartments.

4. An accessory device comprising:

a step ladder having front side rails and rear non-climbing side rails, said step ladder also includes a top cap at a topmost distal end of said step ladder, said top cap has a front face facing said front side rails and a rear face facing said rear non-climbing side rails;

a receiver frame mounted to said top cap at a first end and mounted to said rear non-climbing side rails at a second end, said receiver frame and including a plurality of linear frame members extending about an outer periphery that defines a square or rectangular configuration, the plurality of linear frame members including a front frame member, a rear frame member;

a hinge arrangement having a plurality of hinges each having a first leaf and a second leaf connected to each other using a pin and barrel hinge configuration, said first leaf is mounted flush against said rear face and said second leaf is mounted flush against said rear frame member, said second leaf has a height greater than the height of said rear frame member, said second leaf extends below the periphery of said rear frame member, said first leaf has a height that is equal to the height of said rear face, said pin and barrel hinge configuration is entirely below said top cap, a connection between said first leaf, said pin and barrel configuration, and said second leaf leaves no bottom gap between the rear frame member and the top cap; and a pair of collapsible pivoting support arms mounted between said rear, non-climbing side rails and said receiver frame for allowing movement of the receiver frame relative to the step ladder between an operable position wherein the receiver frame is held supported in a horizontal orientation and a stowed position wherein the receiver frame is collapsed down towards the rear, non-climbing side rails of the step ladder.

5. The accessory device of claim 4 further including a rectangular or square shaped removable tray said receiver frame has an entirely open bottom to allow said removable tray to rest within said open bottom.

6. The accessory device of claim 2, wherein said tray is square or rectangular shaped.

7. The accessory device of claim 2, wherein said tray is removable from the receiver frame.

* * * * *